United States Patent [19]

Jones

[11] Patent Number: 4,919,975

[45] Date of Patent: Apr. 24, 1990

[54] METHOD OF PRODUCING A PAINTED MARBLEIZED FINISH ON AN EXPOSED SURFACE

[75] Inventor: Evan W. Jones, Surfside

[73] Assignee: BPMF, Inc., Miami, Fla.

[21] Appl. No.: 128,232

[22] Filed: Dec. 3, 1987

[51] Int. Cl.[5] ..... B05D 5/00; B05D 1/28; B05D 1/36

[52] U.S. Cl. ..... 427/260; 427/263

[58] Field of Search ..... 427/260, 262, 263, 267, 427/268

[56] References Cited

U.S. PATENT DOCUMENTS 1,185,869 6/1916 Blake ..... 427/262
1,867,068 7/1932 Fowler ..... 427/260
4,317,847 3/1982 Batistelli ..... 427/262 X

*Primary Examiner*—Evan Lawrence
*Attorney, Agent, or Firm*—Malloy & Malloy

[57] ABSTRACT

A method for providing a painted marbleized finish on an exposed wall or ceiling surface, or other exposed surfaces, specifically through the use of an applicator structure dimensioned and configured to apply, in a cooperative manner, first a base coat preferably of paint and secondly an accent coat of paint of a clearly distinguishable and contrasting color. The applicator is further used to accomplish a blending procedure of the accent coat and base coat with one another on the exposed surface being painted in a manner which will affect the visual appearance of natural marble on the surface being painted.

12 Claims, 4 Drawing Sheets

FIG. 1
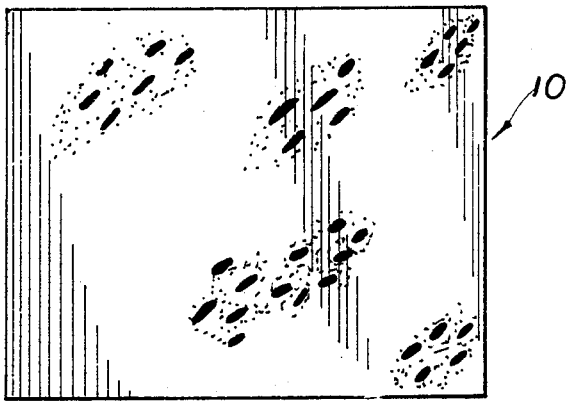
FIG. 8
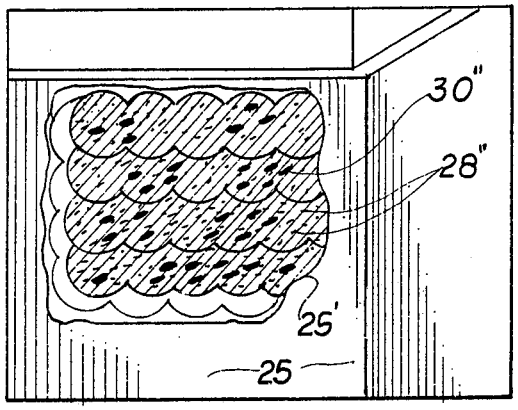
FIG. 2
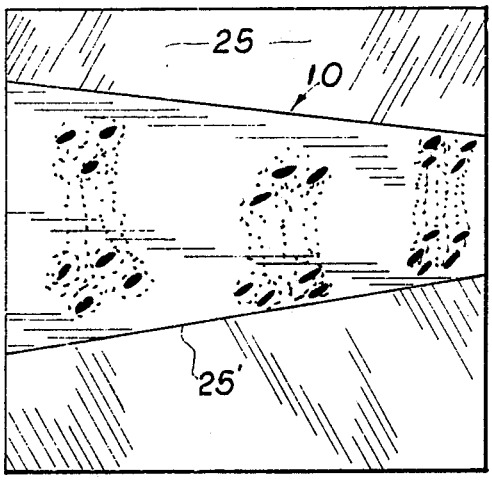
FIG. 9
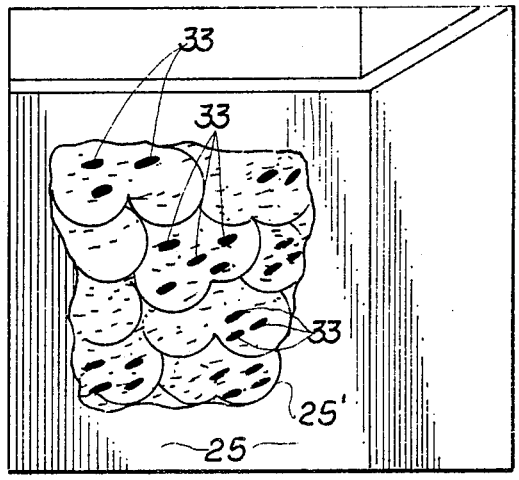
FIG. 7
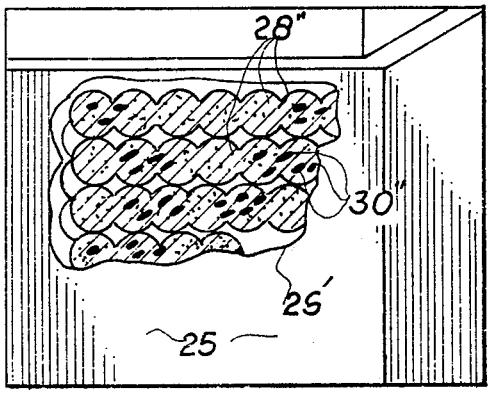
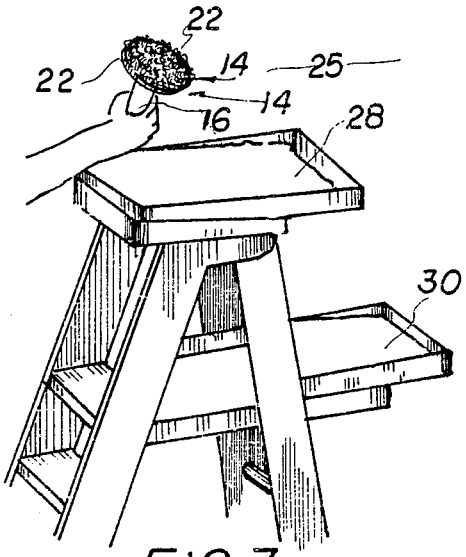
FIG. 3

FIG. 12
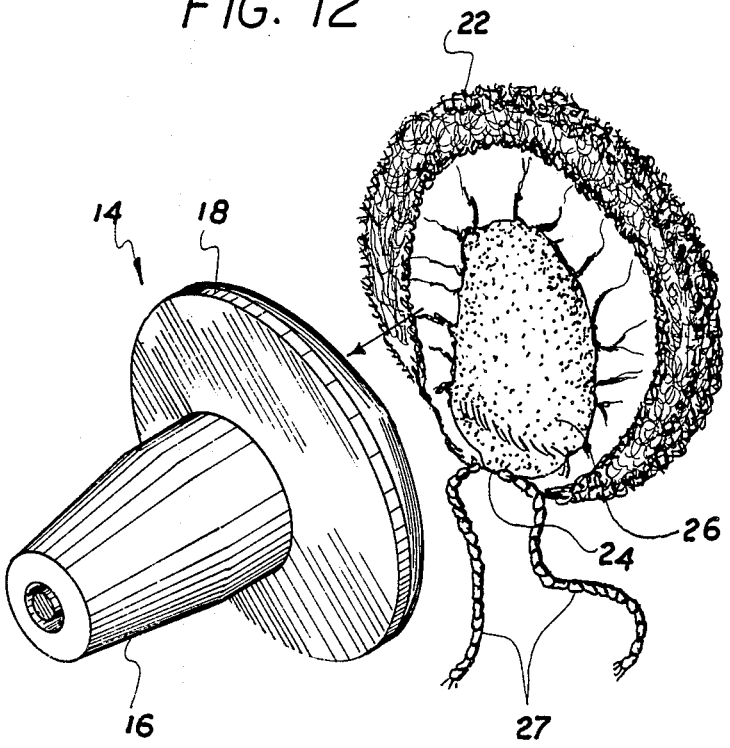
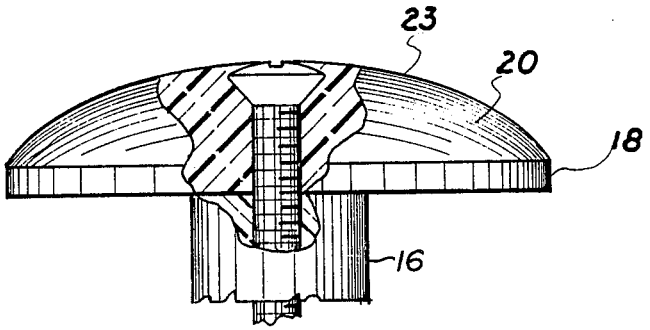
FIG. 13

METHOD OF PRODUCING A PAINTED MARBLEIZED FINISH ON AN EXPOSED SURFACE

BACKGROUND OF THE INVENTION

1. Field of the Invention

This invention relates to a method of accomplishing a painted marbleized finish on an exposed wall or ceiling surface specifically through the use of one or more applicators each having a predetermined construction and configuration which enables both the application of a base coat and accent coat of paint in a prescribed manner and the blending of these contrastingly colored paints to accomplish the aforementioned marbleized appearance.

2. Description of the Prior Art

Traditional marbleized faux finishes are accomplished utilizing the highly skilled and artistic decorative techniques in which the appearance of naturally occurring marble is accurately reproduced onto a surface such as a wall, ceiling, trim or the like. In the painting or decorating industry, a conventional "marblezing" process is known. Typically, such known techniques have been used to decorate interior surfaces that would otherwise be impossible to manufacture or install with marble because of the shape of the surface or the extreme expense of using natural material. Today, the marbleizing process is used not only because of its adaptability and cost effectiveness, but also because the colors of the marbled surface can be customized in order to aesthetically combine diverse elements of a particular design scheme.

Previously, known marbleizing techniques employed a skilled artisan's sense of color and shading to manipulate various types of paints, glazes, solvents and coloring agents. These mediums were applied to the surface with specifically designated and specialized brushes, sponges, feathers, rags or tissue paper. The traditional marbleized finish is a complex, multi-step process. It involves several applications of thinned, translucent paints, called glazes, applied on top of a base coat of an opaque oil base enamel. The glazes are applied to the base coat and then gently rubbed and mottled with the various brushes, rags or sponges until some or all of the glaze has been removed from various areas of the surface. The desired affect is a lightly shaded and uneven finish that allows some of the color of the previous coat to show through the outercoating layers. As each successive layer of glaze is applied, parts of the most recent glaze coat and each of the previous glaze coats are visible. The "veins" characterizing natural marble are added with the help of brushes or feathers. These are applied to resemble the natural spontaneously curving configuration of real marble veins. Finally, due to the fragile nature of the glazes, several coats of clear gloss varnish are applied over the entire surface to protect it and add additional depth of color.

The general concept is one of layered coats that due to their translucency provide a depth of color and shading that, if applied artistically, will closely resemble naturally occurring marble. The traditional marbleizing process requires trained artistic manipulation of colors. Extensive experience in the various types of paint mediums and solvents along with the use of specialized application tools is also a necessity.

SUMMARY OF THE INVENTION

The present invention is directed to a method of producing a painted, marbleized finish on exposed surfaces such as but not limited to wall or ceiling surfaces. Important in the performance of the method in an efficient manner to accomplish the desired aesthetic appearance of the finished surface, is the use of a specific applicator structure. The applicator is specifically designed to reduce the complex, multi-step process of traditional finishing techniques into a single, easily accomplished application process.

The method and applicator utilized in the performance thereof incorporates a radically different approach in the completed marbleized finish. More specifically, instead of using the concept of layered colored coats to create the shaded look of real marble, the subject method and applicator incorporates the use of a plurality of opaque commercially available paints of contrasting colors. These paints are blended together after application to the exposed surface in a prescribed manner while each coating of paint is still wet in order to subtly mix each color with the other.

The blending step of the subject method utilizes the subject applicator in creating the same illusion of the layered shading of the desired marbleized finish previously only obtainable by trained artisans requiring extended periods of time working on a single surface.

Generally, a layer of white or lighter colored oil or latex base flat or enamel type paint is applied to the wall as a base coat in a prescribed manner using the subject applicator. An accent coat of paint of contrasting color is then added by patting randomly spaced patterns or applicator marks of the desired paint on the previously applied base coat. Before the coat of either the base coat or accent coat has begun to dry, the randomly disposed applicator marks are then patted with the applicators in a blending motion towards each other from their originally spaced apart location. This has the effect of blending and shading the entire area until the application marks on the accent coat are no longer individually distinguishable from one another. Due to the specifically designed outer or exposed surface of the applicator portion of the applicator, and the curved or convex configuration of the support surface of the head portion of the applicator holding the applicator portion, this blending process is easily and readily accomplished with a minimal amount of time, requiring knowledgeable but not necessarily highly skilled labor. The resulting surface color takes on a shaded and blended appearance highly characteristic of natural marble. The veins, previously laboriously added in the traditional marbleizing process by skilled artisans, are now developed utilizing the method and applicator of the subject invention, as a matter of course in the blending process. They may be emphasized later if desired.

Because the paint material used is a durable enamel type paint, no additional coats of protective varnish are needed. The surface coloration and shading is richly diverse in and of itself due to the unique blending process of the applicator structure and design configuration.

The invention accordingly comprises a plurality of steps as well as a combination of elements comprising a subject applicator which will be exemplified in the description hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which:

FIG. 1 is a front view of the subject marbleized finish after the process of the subject invention has been completed utilizing applicator structure also considered part of the present invention.

FIG. 2 is a section of a wall surface or like structure incorporating the marbleized finish.

FIG. 3 is a perspective view showing preparation of the applicator structure in performing the present invention.

FIG. 7 shows a further blending together of the accent coat over the base coat.

FIG. 8 shows yet an additional further blending of the accent coat.

FIG. 9 shows a finished section with accent marks contained thereon.

FIG. 12 is a perspective view in partial exploded form of components of an applicator assembly used to practice the subject method as described herein.

FIG. 13 is a side elevation in partial cutaway showing details of the head structure of the applicator.

Like reference numerals refer to like parts throughout the several views of the drawings.

DETAILED DESCRIPTION OF THE PREFERRED EMBODIMENT

Figure 5:
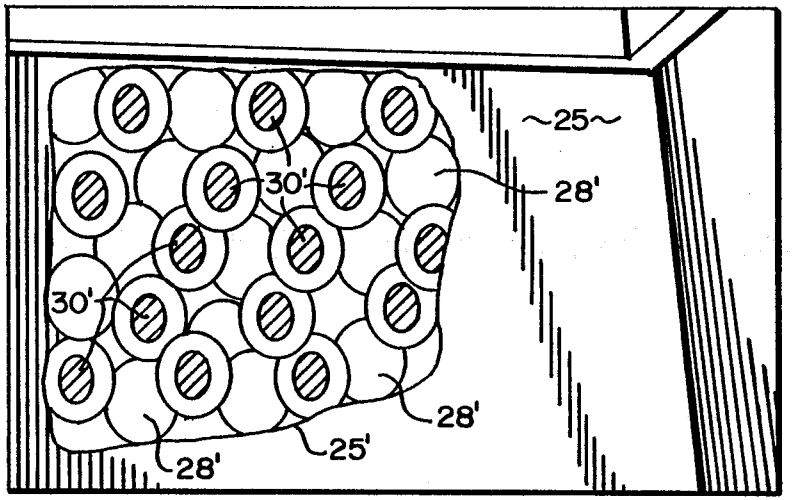
FIG. 5 shows a section of wall surface having both the base coat and the accent coat applied thereto in specific spaced apart patterns.

The present invention relates to a method of producing painted, marbleized finishes on the exposed surfaces of ceilings, walls, etc., as generally indicated as 10 in FIGS. 1 and 2, in an efficient, reliable and aesthetically pleasing manner utilizing applicators 14 specifically structured and configured to accomplish the various steps of the method in a prescribed manner which alleviates many of the recognized problems existing in the prior art.

More specifically, the applicator 14 referred to herein (see FIGS. 3, 12 and 13) comprises a handle portion 16 preferably having an elongated configuration with a head portion 18 secured to one end thereof. The handle 16 may be fixedly or removably attached to the head portion 18 by a screw type or other conventional connectors. The head portion 18 has a substantially disc-like configuration with an outer exposed supporting surface 20. The supporting surface 20 is curved into a substantially convex configuration. In addition, the head portion has a somewhat disc-like shape oriented in transverse relation to the longitudinal axis of the handle 16. The handle 16 may take any of a variety of configurations but should be of sufficient length and configuration to be easily grasped by one hand such that the applicator can be easily manipulated thereby (see FIGS. 3 and 4).

The applicator 14 of the present invention may be considered part of an applicator assembly which further comprises a boot 22. The boot is in the form of a cover or sleeve having an open end 24 communicating with a hollow interior 26. The boot 22 is formed from an at least partially flexible material such that the boot can be fitted entirely about and in covering and at least partially surrounding relation to the head portion 18 of the applicator. In such position, a surface of applicator portion 23 is covered by the boot 22, and has a preferably soft, fluffy material from which it is formed. The material of the exposed surface of the boot 22 is specifically structured to be able to receive paint thereon and transfer paint therefrom onto the exposed surface 25 in the manner to be described in greater detail hereinafter. A tie string 27 or other conventional connector can be used to effectively close the open mouth 24 of the boot 22 about the underportion of the disc-shaped head 18. The applicator portion 23 is similarly attached. The boot 22 is removably attached in the aforementioned fashion and the applicator portion 23 and boot 22 all positioned in overlying and supporting relation on the supporting surface 20 of the head portion 18.

In the performance of the subject method of the present invention, it is preferable to use two applicators 14 (see FIGS. 3 and 4), one in each hand, with the aforementioned boot 22 and applicator portion removably secured thereto. However, it should be noted that a single applicator 14 could in fact be used although such manner of use may be more time consuming than if two applicators were used in the manner described hereinafter.

Prior to initiating the various steps of the subject method, the exposed surface 25 should be prepared to the extent of at least cleaning such exposed surface by removing any contaminants such as grease, wax, dirt or any other material which would derogatorily affect the adherence of paint to the surface.

If peeling paint, holes or cracks exist in the surface, such surface should be scraped and the imperfections patched with spackel. Spot primer should be used on all patches. In the event of wallcovering, all such existing wallcovering should be removed as well as any paste residue used to secure the wallcovering to the wall surface. If the surface to be finished is heavily discolored, or if any wallcoverings were removed, the surface to be finished, for best results, should be primed with a good quality egg shell primer to provide a sound surface of uniform appearance.

Glossy enamel surfaces should be first sanded with an 80 or 100 grit sand paper to provide proper adhesion. New sheet rock or plaster should be primed with one or two coats of enamel undercoater to provide a sealed surface of uniform appearance.

In operation and as shown in FIG. 3, a first quantity of base coat paint 28 and a second adequate quantity of accent coat paint 30 should be placed in an accessible position, but not mixed prior to use. In a preferred embodiment, both the base coat paint 28 and the accent coat paint 30 are formed of any type of commercially available oil or latex base flat or enamel type finish paint wherein the accent coat paint 30 is preferably of a clearly contrasting color to the much lighter or white color of the base coat paint 28.

The boots 22 referred to in association with the above set forth applicator assembly 14 is secured over the head portion 18 such that the applicator surface of each boot 22 readily exposed and accessible. The boot 22 of each applicator 14 should be dipped into the supply of base coat paint 28 and then spread evenly onto both boots 22 of both applicators 14 by rubbing them together in a preferably circular motion (see FIG. 3).

A designated surface portion generally indicated as 25' (see FIG. 4) of the entire exposed surface 25 to be finished is determined. A conventionally sized wall surface or ceiling surface is divided into a plurality of designated portions 25', 25" depending upon the size of the surface 25 to be finished as shown and described in greater detail in FIG. 11. One designated portion 25' is done at a time and immediately adjacent designated portions 25" are blended together in a manner to be described hereinafter upon the completion of the subsequent adjacent designated portion.

Figure 4:
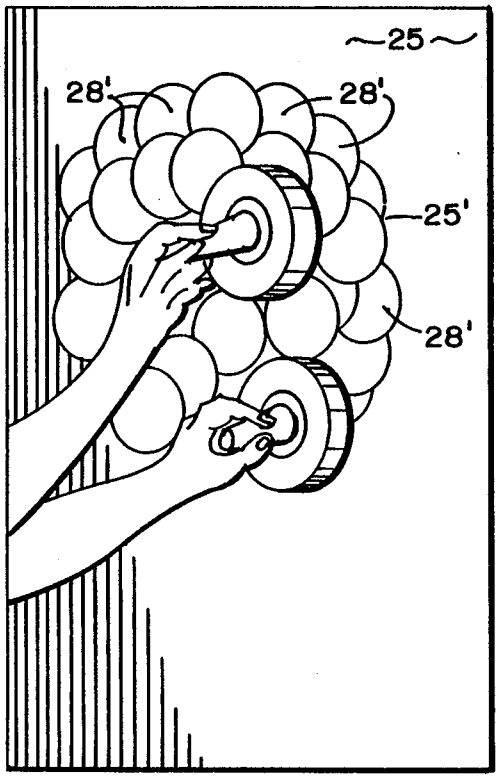
FIG. 4 is a perspective view showing the application of a base coat of paint to a designated wall surface or section thereof.
Figure 10:
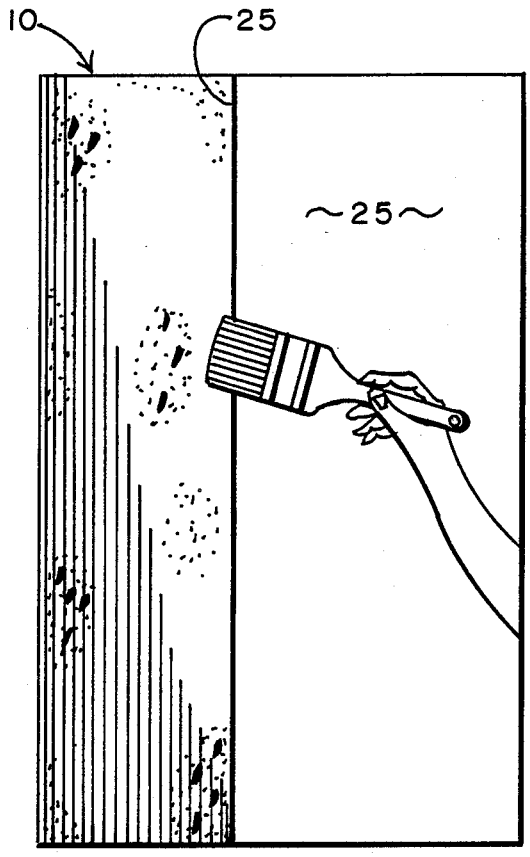
FIG. 10 is a perspective view showing border areas of the surface being painted filled in by a brush or like conventional instrument.

After placing the base coat paint 28 on both applicators 14, the base coat paint 28 is patted onto the wall surface throughout the designated portion 25' with a rhythmical alternating and repeating motion using first one pad and then the other pad both carried by the different hands of the user (see FIG. 4). The base coat paint 28 should be applied quite heavily so that it will almost run. It will be noted that the placement of the boot 22 of each applicator on the surface to be finished will imprint an applicator mark or pattern mark thereon which corresponds to the size and configuration of the exposed surface of each boot 22. The patterns, preferably circular to conform to the configuration of the applicator surface, should be applied such that the applicator marks of the base paint 28' overlap one another as shown in FIGS. 4 and 5. (The parallel diagonal lines shown in FIG. 5 and subsequent figures represent a mixture of accent coat and base coat produced by the applicator.) The base coat should be applied by the applicators in the manner set forth above in an irregularly shaped section 25' defining the aforementioned designated portion of a size preferably 3 to 4feet on each side. The base coat paint should not be applied at this time to the trim and sealing line, but should be spaced therefrom. Such spaces left blank will be filled in by conventional a 2-inch bristle-type brush as will be explained with regard to FIG. 10.

After the base coat paint 28 is applied to the designated portion 25' in the form of a plurality of applicator marks 28' as set forth above, the boots 22 of the same two applicators 14 have the accent coat paint 30 applied thereto. One applicator is dipped into the supply of accent paint 30 and such accent paint is distributed onto both applicators 14 using the aforementioned circular motion as the applicator portions are rubbed together. The white base coat paint 28 already present on the exposed applicator surface of each boot will smear slightly but this is normal and in fact contributes to the natural look of the finished work.

Figure 6:
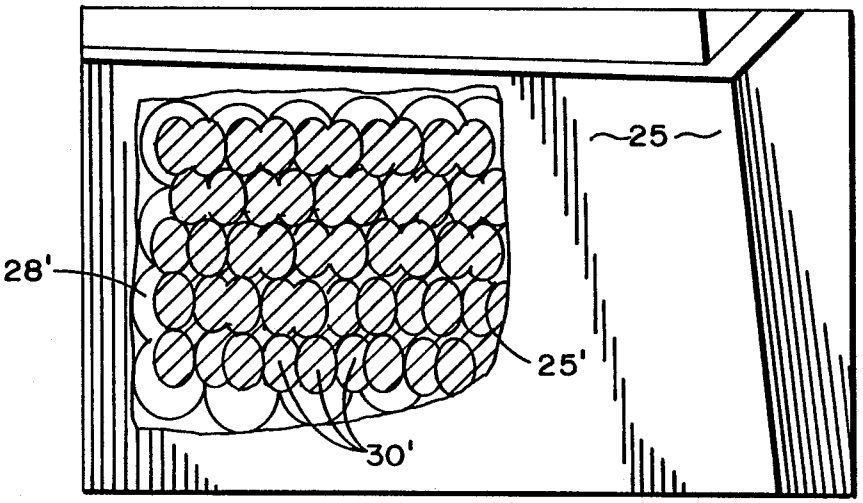
FIG. 6 shows a blending together of the accent coat patterns from the originally spaced apart position as shown in FIG. 5.

The accent coat paint 30 should be patted onto the wall surface in an irregular pattern of applicator marks 30' directly over the marks 28' of the previously applied base paint as shown in FIG. 5. Each applicator mark 30' is clearly distinguishable from the white or light colored base paint 28 and each applicator mark 30' is preferably applied so as to have a somewhat slightly different shade by using more or less of the accent coat paint 30 on a given applicator 14. These randomly placed applicator marks 30' will add to the natural and spontaneous look of the finished section. It should be noted that the fewer applicator marks 30' of the accent paint 30 placed over the base coat paint 28', which now covers the designated portion 25' of the exposed surface 25, will result in a proportionately lighter marble look of the finished product. Conversely, the more applicator marks 30' or the heavier the accent paint 30 is applied to as applicator marks 28' of the base coat paint 28, the darker, more dramatic the finished product will appear. After the initial application of the applicator marks of the accent coat paint 30' on the base coat paint 28' have been applied, a continuous patting of the entire exposed surface of the designated portion should be accomplished repeatedly and quickly so as to blend each of the applicator marks 30' of the accent coat towards one another until they become substantially indistinguishable. Successive stages of blending are shown in FIGS. 6, 7 and 8. (For convenience of illustration, base coat marks have been shown as black dots, even though they are white.). The supplying of additional accent coat paint 30 to the applicator portions should not be done at this time. Continuous blending of the entire exposed surface of the designated portion by continuous patting should be continued to define an initial blending step until the outline of each applicator mark of the accent coat paint has been muted or becomes indistinguishable from one another (see FIG. 6). The result is an overall blended pattern of the application marks 28' and 30'. This blending continues into a subsequent blending step by further patting of the applicators 14 resulting in a blending of the accent coat paint 30' into the base coat paint 28' but in a manner which allows smaller marks of white base coat 28" to be viewable through the accent coat. Additionally, small quantities of the accent coat as at 30" are viewable independently of the other blended together base and accent coat paint 28', 30' as shown in FIG. 7 and 8.

A final blending step is conducted where the blending is continued to obtain the desired marbelized appearance without over blending which would cause the colors to become solid in appearance.

Figure 11:
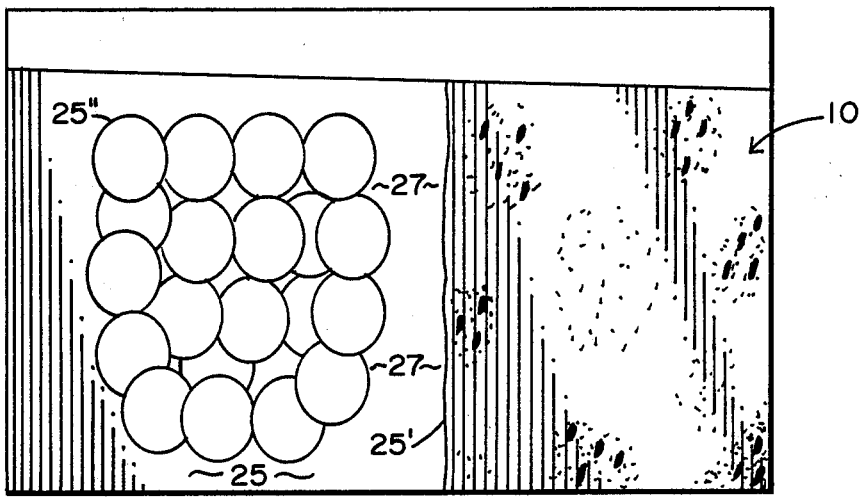
FIG. 11 shows the beginning step of applying a base coat to an immediately adjacent surface section to a finished surface section containing the finished marbleized surfacing.

As set forth above, the entire exposed surface 25 of the wall or ceiling being finished is done in designated sections 25', 25", etc. which are initially spaced from one another (see FIG. 11). After the first section 25' has been blended and to the point where the desired depth of color is achieved, the second designated section 25" should be finished in the same manner as the first designated section 25'. In any designated section, areas which appear initially too dark can be rectified by applying additional wet base coat paint 28 by an applicator 14 until the desired degree of lightness is in fact achieved. Blending can occur in a manner similar to that set forth above. Once the second designated portion 25" has completed the second blending step and the desired depth of color is achieved therein, the two sections are blended together by taking the almost blank area 27 therebetween (see FIG. 11) and performing the same steps of application of base coat paint 28 and subsequently accent coat paint 30 by the applicators 14, in the same manner, and following through with the first and second blending steps.

It is important to note that upon the completion of any second adjacent section 25", the blending of the space 27 between the two sections 25' and 25" be accomplished immediately thereafter.

After the entire exposed wall or ceiling surface 25 has been completed, drying will naturally occur. As the wall dries, the sheen of the painted marble finish will lose its glossiness and take on a rich satiny look. After it has dried, one may make minor touch-ups in areas which appear too dark or generally "uninteresting" such that they are not shaded to the satisfaction of one performing the work. It should be noted that such touch-up should not occur until complete drying has taken place.

If a more dramatically "veined" look is desired, random marks 33 of accent color can be added at various locations throughout the entire exposed surface (see FIG. 9). Next, such accent color marks 33 are covered with small amounts of wet base coat paint. Such areas are then gently blended by patting the wet base coat and accent colors together to form the desired painted marbleized finish including a sloping, preferably linear appearance of small clusters so as to closely resemble the natural "veined" appearance of marble.

As set forth above, the painted marble finish can be used to effectively finish walls around a specific colored decor. Such finish can be blended to match any desired feature such as the laminate in a kitchen or the carpets and furniture in a bedroom. A very subtle marble background can be accomplished and such may vary to a very dramatic and distinguished multiple veined appearance.

What is claimed is:

1. A method of producing a painted marbleized finish on an exposed surface such as a wall or a ceiling, said method comprising the steps of:

(a) preparing the exposed surface by at least insuring that the exposed surface is substantially clean and free of contaminants;

(b) placing a supply of base coat paint on an outer applicator surface of a hand-held applicator;

(c) applying the base coat paint by forming a plurality of overlapping application marks of the base coat paint on the exposed surface by patting the applicator surface of the applicator repeatedly over at least one designated portion of the exposed surface;

(d) placing a supply of an accent coat paint of a different, contrasting color than the base coat paint on the same applicator and while the applied base coat paint is still wet on the exposed surface, applying the accent coat paint by forming a plurality of application marks of the accent coat over the base coat paint on the on designated portion of the exposed surface;

(e) positioning the application marks of the accent coat in spaced relation to one another;

(f) subsequently patting the exposed surface within the designated portion with the applicator surface of the applicator and thereby performing an initial blending of the plurality of application marks of the accent coat toward one another from their original spaced apart locations until each of the plurality of application marks of the accent coat is blended into one another and is substantially indistinguishable from one another;

(g) performing a subsequent blending of the accent coat into the still wet base coat by continuously patting the applied accent coat with the applicator surface and allowing small portions of the base coat as well as small quantities of the accent coat to be viewable through the blended exposed surface; and (h) performing a final blending of the accent coat into the base coat by additional continuous patting by the applicator surface of the accent coat and base coat until a desired depth of color having a painted marbleized finish in appearance is achieved over the one designated portion of the exposed surface.

2. A method as in claim 1 further comprising sequentially producing the painted marbleized finish on spaced apart other designated portions than said one designated portion and on the same exposed surface, the number of designated portions being dependent on the size of the exposed surface.

3. A method as in claim 2 further comprising:

applying the base coat to the exposed surface between the designated portions by patting the applicator repeatedly thereon;

positioning the application marks of the base coat on the exposed surface between the designated portions by the applicator in overlapping relation to one another;

placing a supply of an accent coat of paint of different contrasting color than the base coat on the same applicator and while the applied base coat is still wet, applying the accent coat over the base coat on the surface;

positioning the application marks of the accent coat in spaced relation to one another on the exposed surface between the designated portions;

subsequently patting the exposed surface between the designated portions with the applicator and thereby initially blending the plurality of application marks of the accent coat toward each other from their original spaced apart locations until each of the plurality of application marks of the accent coat is blended into one another and substantially indistinguishable from one another;

performing a subsequent blending of the accent coat into the still wet base coat by continuously patting the accent coat with the applicator while allowing small portions of the base coat to be viewable through the accent coat; and performing a final blending of the accent coat into the base coat by a continuous patting by the applicator of the accent coat and base coat until a desired depth of color having a painted marbleized finish in appearance is achieved between the designated portions of the exposed surface.

4. A method as in claim 3 further comprising blending together two adjacent designated portions immediately after completion of the last designated portion.

5. A method as in claim 1 further comprising using two applicators, one in each hand, and applying first the application marks of the base coat and subsequently the application marks of the accent coat to the exposed surface.

6. A method as in claim 5 comprising applying the base coat and accent coat respectively by alternately and repeatedly contacting different ones of the applicator surface of the two applicators onto the exposed surface utilizing both hands of the user.

7. A method as in claim 1 comprising completing final blending to accomplish the desired depth of color without adding an additional amount of accent coat to the exposed surface.

8. A method as in claim 7 comprising initially applying a greater number of application marks of the accent coat over the base coat in direct proportion to the heavier the depth of color desired after the final blending.

9. A method as in claim 7 further comprising applying a plurality of application marks of the base coat subsequent to the final blending, to undesirably dark and solid appearing surface areas of the exposed areas until a desired contrast in appearance is accomplished.

10. A method as in claim 7 comprising initially applying a lesser number of application marks of the accent coat over the base coat and to the exposed surface wherein the number of application marks of the accent coat applied is directly proportional to the lighter the depth of color desired after the final blending.

11. A method as in claim 7 further accomplishing an increased veined appearance by first applying random pattern marks of the accent coat in small spaced apart clusters and subsequently, substantially covering the random pattern marks of the accent coat with wet base coat and blending the wet base coat and pattern marks of the accent coat together to form a desired color pattern with a marbleized appearing finish.

12. A method as in claim 11 comprising shaping the random pattern marks into sloping, substantially linear configurations to resemble a veined appearance of natural marble.

* * * * *